US007086319B2

(12) United States Patent
Larroque-Lahitette et al.

(10) Patent No.: US 7,086,319 B2
(45) Date of Patent: Aug. 8, 2006

(54) DEVICE TO PROVIDE AN ELECTRICAL CONNECTION BETWEEN A RECOILING MASS OF A WEAPON AND A FIXED CRADLE

(75) Inventors: Gilles Larroque-Lahitette, Lagor (FR); Pascal Sabourin, Bourges (FR)

(73) Assignee: Giat Industries, Versailles (FR)

( * ) Notice: Subject to any disclaimer, the term of this patent is extended or adjusted under 35 U.S.C. 154(b) by 96 days.

(21) Appl. No.: 10/724,610

(22) Filed: Dec. 2, 2003

(65) Prior Publication Data

US 2005/0109201 A1 May 26, 2005

(30) Foreign Application Priority Data

Dec. 2, 2002 (FR) ..... 02 15173

(51) Int. Cl.
*F41A 19/69* (2006.01)

(52) U.S. Cl. ..... 89/28.1; 89/135

(58) Field of Classification Search ..... 89/28.05, 89/28.1, 28.2, 135, 1.811; 42/84
See application file for complete search history.

(56) References Cited

U.S. PATENT DOCUMENTS

| | | | | |
|---|---|---|---|---|
| 1,917,813 | A * | 7/1933 | Ruhlemann | 89/1.1 |
| 1,917,814 | A * | 7/1933 | Ruhlemann | 89/1.1 |
| 2,342,705 | A * | 2/1944 | Summerbell | 89/149 |
| 2,436,379 | A * | 2/1948 | Chinn | 89/41.12 |
| 2,688,203 | A * | 9/1954 | Gaidos | 42/75.01 |
| 2,750,846 | A * | 6/1956 | Grover | 89/33.03 |
| 2,800,057 | A * | 7/1957 | Hoopes | 89/28.05 |
| 2,805,604 | A * | 9/1957 | Humphrey | 89/135 |
| 2,898,812 | A * | 8/1959 | Meyer | 89/135 |
| 3,072,021 | A * | 1/1963 | Marcon | 89/1.811 |
| 3,094,932 | A * | 6/1963 | Greenlees | 102/202.2 |
| 3,584,532 | A * | 6/1971 | Stoner et al. | 89/47 |
| 5,044,278 | A * | 9/1991 | Campbell | 102/202.8 |
| 5,220,126 | A | 6/1993 | Borgwarth et al. | 89/28.05 |
| 5,233,902 | A | 8/1993 | Bernardes | 89/24 |
| 2002/0046643 | A1 | 4/2002 | Breuer et al. | 89/28.05 |

* cited by examiner

*Primary Examiner*—Stephen M. Johnson
(74) *Attorney, Agent, or Firm*—Oliff & Berridge, PLC

(57) ABSTRACT

A device providing an electrical connection between the recoiling mass of a weapon and a fixed cradle. The device incorporates at least one connector formed of a plug and socket, one of which is integral with the cradle and the other with the recoiling mass, the elements being disconnected during the recoil of the recoiling mass.

6 Claims, 4 Drawing Sheets

DEVICE TO PROVIDE AN ELECTRICAL CONNECTION BETWEEN A RECOILING MASS OF A WEAPON AND A FIXED CRADLE

BACKGROUND OF THE INVENTION

1. Field of the Invention

The technical scope of the invention is that of devices providing an electric connection between a recoil mass of a weapon and a fixed frame.

2. Description of Related Art

In known weapons, the electrical connection between the recoil mass and the fixed cradle is provided by a fixed contact touch needle that presses with a contact integral with the recoil mass.

The electrical energy developed using such a solution is reduced (around a few hundreds of milliJoules) and is enough to ignite an electrical igniter of the ammunition.

This solution is ill adapted to weapons implementing plasma igniters. Indeed, the latter are powered by high voltage (of around 5 to 20 kilo volts) and high energy (of around a few hundred kilo Joules) impulses.

The characteristics of the contact touch needle are such that the energy developed would cause the contacts to fuse and destroy the electrical supply.

Moreover, it is not desirable, given the constraints in integrating them, to use long-length cables, fixed at one end to the cradle and at the other to the recoiling mass, that accompany the recoil movement of the weapon.

The aim of this invention is to propose an electrical connection device that overcomes such disadvantages.

Thus, the device according to the invention provides a reliable connection between a recoiling mass and a cradle of a weapon whilst enabling a substantial current to flow through (of around several hundred kilo Joules).

SUMMARY OF THE INVENTION

Thus, the invention relates to a device providing an electrical connection between the recoiling mass of a weapon and its fixed cradle, device wherein it incorporates at least one connector formed of a plug and a socket, one of which is integral with the cradle and the other with the recoiling mass, the elements being disconnected during the recoil of the recoiling mass.

Advantageously, the plug or socket integral with the cradle may also be integral with motor means allowing it to be displaced so as to make sure it disconnects when the recoiling mass is in the starting position before firing.

The pins of the plug may be integral with a support made of a flexible insulating material.

The socket may incorporate at least two cylindrical contact terminals whose inner diameter will be slightly less than that of the plug's contact pins, each terminal will incorporate a longitudinal slot allowing it to deform radially when the pin is introduced.

The plug may incorporate at least two contact pins whose free length out of the plug will be greater than or equal to that of the terminals.

The plug may be integral with the cradle and the socket integral with the recoiling mass.

BRIEF DESCRIPTION OF THE DRAWINGS

The invention will be made more apparent by the additional description given hereafter of a particular embodiment, such description being made in reference to the appended drawings, in which.

DETAILED DESCRIPTION OF PREFERED EMBODIMENTS

Figure 1:
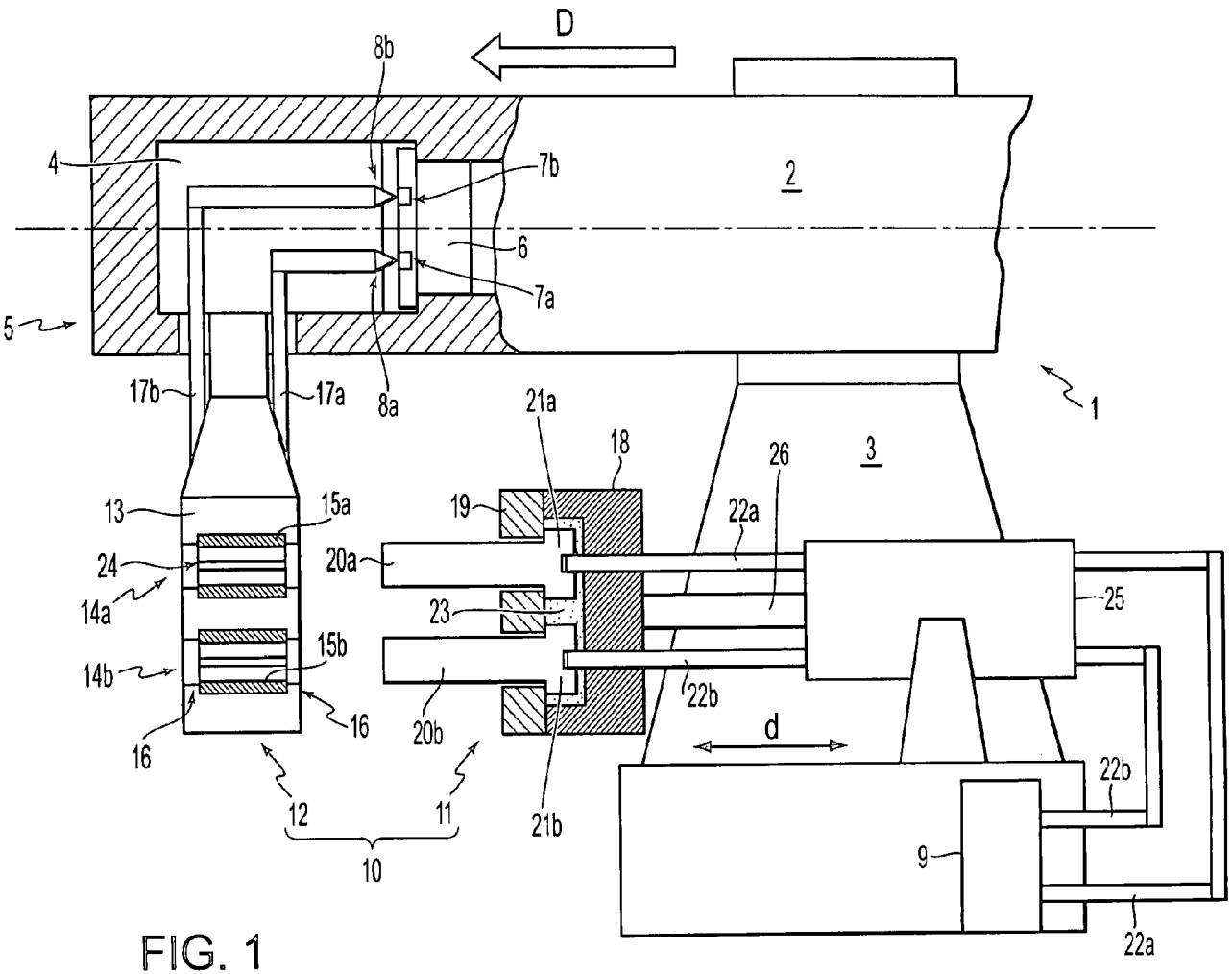
FIG. 1 is a schematic overview showing a weapon fitted with a connector according to the invention.

With reference to FIG. 1, a weapon 1 incorporates a recoiling mass 2 mounted able to slide with respect to a cradle 3. The recoiling mass 2 comprises a barrel that is fitted at its rear part with a breech sleeve 5, inside which the breechblock 4 is displaced. Such a weapon structure is well known to someone skilled in the art and requires no further description.

Here, the barrel 2 receives a piece of ammunition of which only the obturating base 6 is shown. This base has a primer tube (not shown), which will be, for example, of the plasma type such as described in patents FR2807610 and FR2807611. The primer is ignited by an electrical current, which reaches it via two contact elements 7*a* and 7*b* integral with the base 6 and electrically insulated from one another.

When the breechblock 4 is closed, these contact elements are in electrical contact with two contact touch needles 8*a* and 8*b* integral with the breechblock 4 and connected to an electrical generator 9.

According to the invention, the electrical connection between the contact touch needles 8*a*, 8*b* and the generator 9 is made by means of a connector 10 that comprises a plug 11 and socket 12.

Here, the plug 11 is integral with the cradle 3 of the weapon and the socket 12 is integral with the recoiling mass 2 and more particularly with the breechblock 4.

The opposite arrangement is naturally also possible.

The relative proportions of the connector 10 and the weapon 1 are naturally very exaggerated in FIG. 1 so as to facilitate the description of the connector whilst situating it with respect to the weapon. The connector according to the invention is substantially smaller than the breechblock. A connector according to the invention, once assembled, thus forms a parallelepiped of around 200 mm×200 mm×100 mm.

The socket 12 is formed of a body 13 made of an electrically insulating material, for example a plastic material, having two holes 14*a*, 14*b* inside which metal (for example brass) cylindrical contact terminals 15*a*, 15*b* are positioned. The diameter of the holes 14*a*, 14*b* is smaller on either side of the terminals 15*a*, 15*b* thus immobilizing them axially with respect to the body 13 by shoulders 16. The terminals 15*a*, 15*b* may be embedded in the material of the body 13, which may thus be cast over the terminals. Alternatively, the body 13 may be made of two parts made integral with one another, for example, by screws. This solution will enable the terminals to be disassembled.

Each terminal 15*a*, 15*b* is connected to one of the contact touch needles 8*a*, 8*b* by a conductor 17*a*, 17*b* that passes through the breechblock 4.

The plug 11 incorporates an insulating case 18 closed by a cover 19, also insulating and fastened to the case, for example, by screws. The case 18 encloses two cylindrical contact pins 20*a*, 20*b* that pass through the cover 19 via openings.

Each pin 20*a*, 20*b* has an enlarged head 21*a*, 21*b* electrically connected by welding to an electrical conductor 22*a*, 22*b* itself linked to an electric generator 9.

The insulating case 18 incorporates an inner cavity inside which the heads 21 of the pins 20 are housed. This cavity is filled with a flexible support insulating material 23 (for example, silicon) that encloses the pin heads 21. Additionally, the openings in the cover 19 have a greater diameter that than of the pins (a few tenths of mm). Such characteristics allow the pins 20 to be given a certain liberty of movement enabling a limited pivoting of the axis of each pin with respect to the case 18.

Such an arrangement facilitates the correct positioning of the pins 20*a*, 20*b* with respect to the terminals 15*a*, 15*b* when the connection is established.

Figure 2:
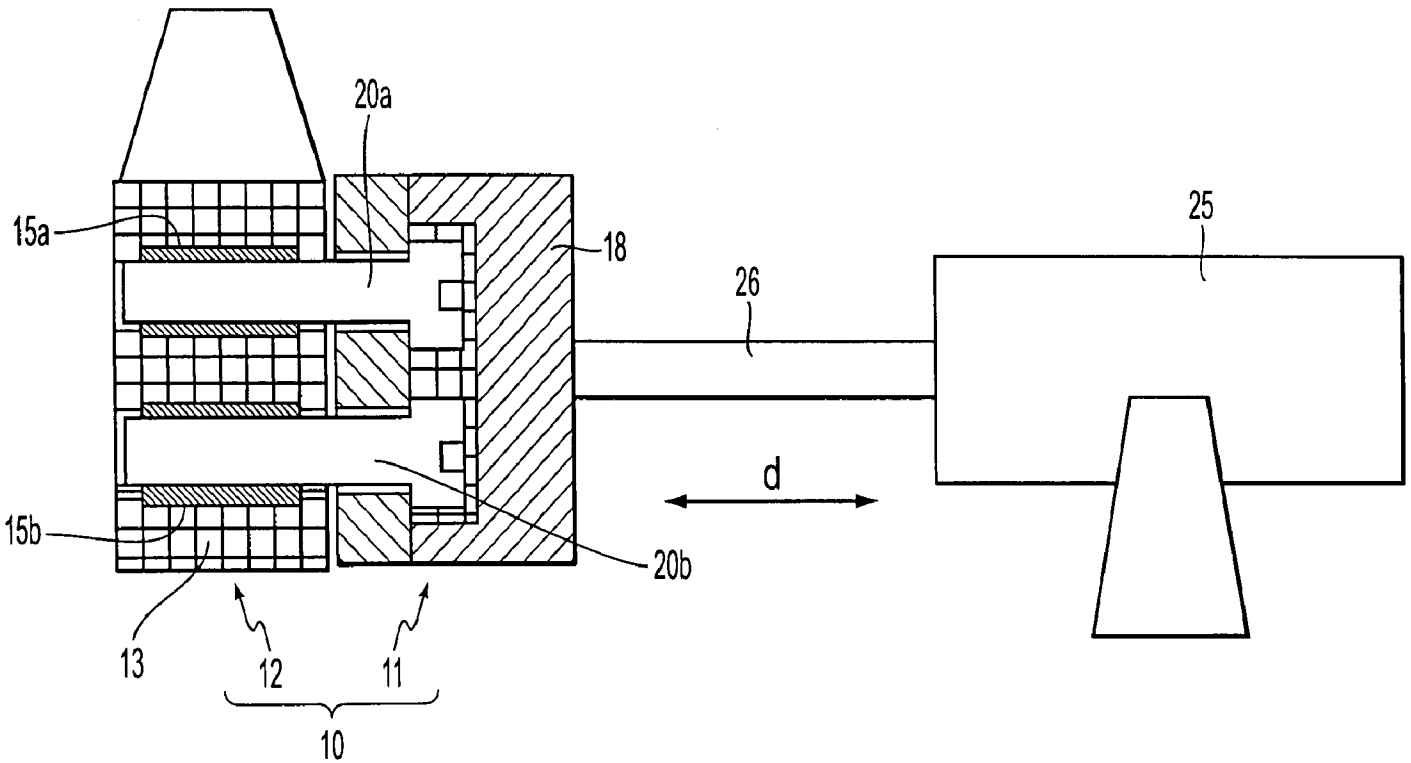
FIG. 2 shows the connector alone in the connected state.
Figure 3:
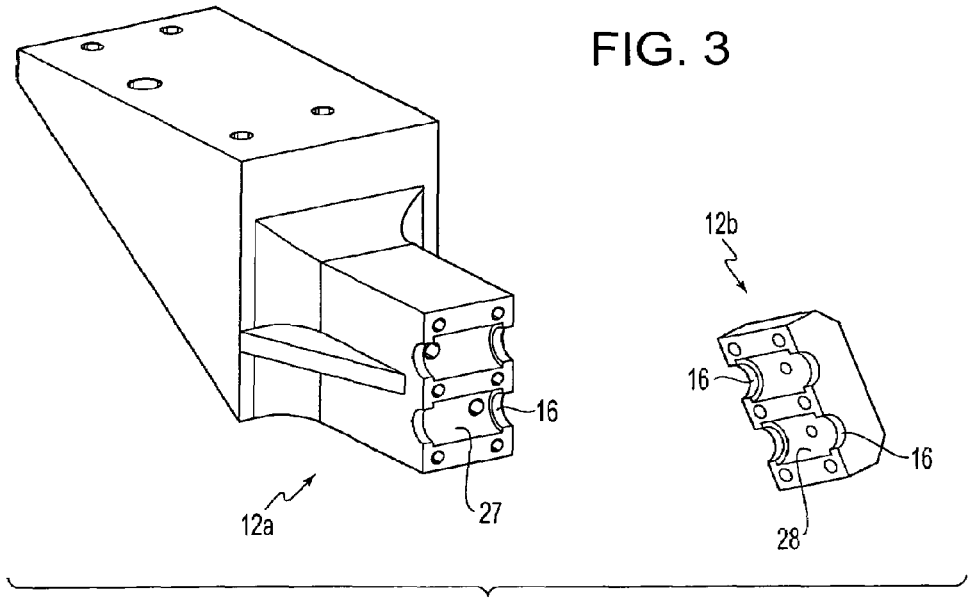
FIG. 3 is a perspective view of one embodiment of a disassembled socket.

Pins 20*a* and 20*b* are intended to be introduced into terminals 15*a*, 15*b* so as to ensure an electrical contact between conductors 22*a*, 22*b* and conductors 17*a*, 17*b*. FIG. 2 thus shows the plug and socket in their connected position.

The length of the pins 20*a*, 20*b* that extend outside the case 18 is selected to be greater than or equal to that of terminals 15*a*, 15*b*. This is to ensure a maximal contact surface.

The inner diameter of terminals 15*a*, 15*b* is slightly less than an outer diameter of contact pins 20*a*, 20*b* of the plug 11. Moreover, each terminal 15 has a longitudinal slot 24 making it possible for it to deform radially when the pin 20 is introduced. Such an arrangement improves the quality of the electrical connection by reducing the electrical contact resistances.

According to another characteristic of the invention, the plug 11 (integral with the cradle) is fastened to motor means 25 which here is constituted by a hydraulic jack whose body is integral with the cradle 3 of the weapon and whose rod 26 is fitted with the plug 11.

By acting on the jack 25, it is thus possible to displace the plug 11 with respect to the socket 12 so as to ensure the connection or disconnection of the plug and socket (displacements following arrow d).

Moreover, because the socket 12 is integral with the recoiling mass 2, the recoil of the mass 2 during firing leads to a relative displacement of the socket 12 with respect to the plug 11, and thus to its disconnection.

The device operates as follows.

Before firing, the breechblock 4 needs to be transversally displaced with respect to the gun barrel 2 so as to allow a piece of ammunition to be loaded into the weapon. To enable such a displacement of the breechblock, the plug 11 must be disconnected from the socket 12. The jack 25 will be employed for this and will control the disconnection (FIG. 1). This disconnection also ensures the safety of the ammunition loading operation since no electrical voltage may be applied to the breechblock 4.

After loading and before firing, the jack 25 is operated in the opposite direction so as to establish the connection between plug 11 and socket 12 (FIG. 2). The flexibility of the pins 20 and the slots 24 in the terminals 15 provides a reliable connection and a good quality of electrical contact. The generator 9 is then activated to supply electrical energy to the ammunition via conductors 22, 17 and connector 10. The electrical characteristics of the contacts established by the connector enable the transmission of electrical power to the tune of several hundred kilo Joules enabling the ignition of a plasma igniter.

Firing the projectile causes the recoiling mass 2 to recoil (in direction D) . The recoil automatically causes the electrical connector 10 to open without any particular mechanical constraints. The jack 25 is controlled, either simultaneously or after recoil has begun, so as to move the plug 11 away from the socket. Such an arrangement ensures that, when the recoiling mass returns into position after recoil, the electrical connection is not automatically re-established, thereby enabling the breechblock 4 to be opened for reloading.

FIGS. 3 to 5*b* show an example of a particular embodiment of a socket 12. Here, this is formed of two parts: a support 12*a* and flange 12*b*, connected to the support 12*a* by screws. The support 12*a* and flange 12*b* are made of an insulating (plastic or composite) material. The support and flange both carry two half-cylinders 27, 28, which constitute housings for the terminals 15 (not shown in FIG. 3). These half-cylinders are delimited by shoulders 16, which immobilize the terminals axially.

Figure 4:
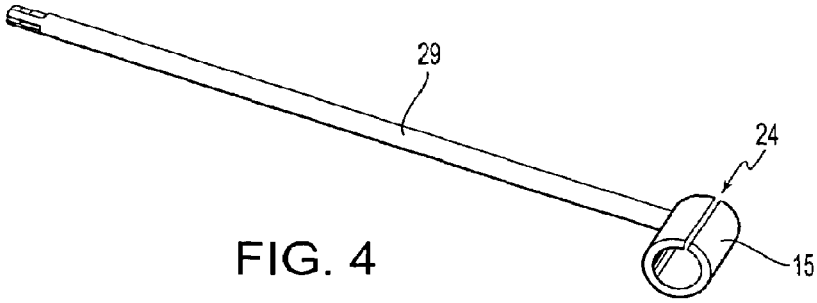
FIG. 4 shows a perspective view of a connector socket.

FIG. 4 shows a perspective view of a terminal 15 before being set into position in housings 27, 28. The terminal 15 is made of brass and the slot 24 ensures its flexibility. A conductive rod 29 is integral with the terminal 15, to which it is fastened by welding. The rod 29 conducts the current through the support 12*a*, through which it passes via a hole (not shown in FIG. 3).

Figure 5A:
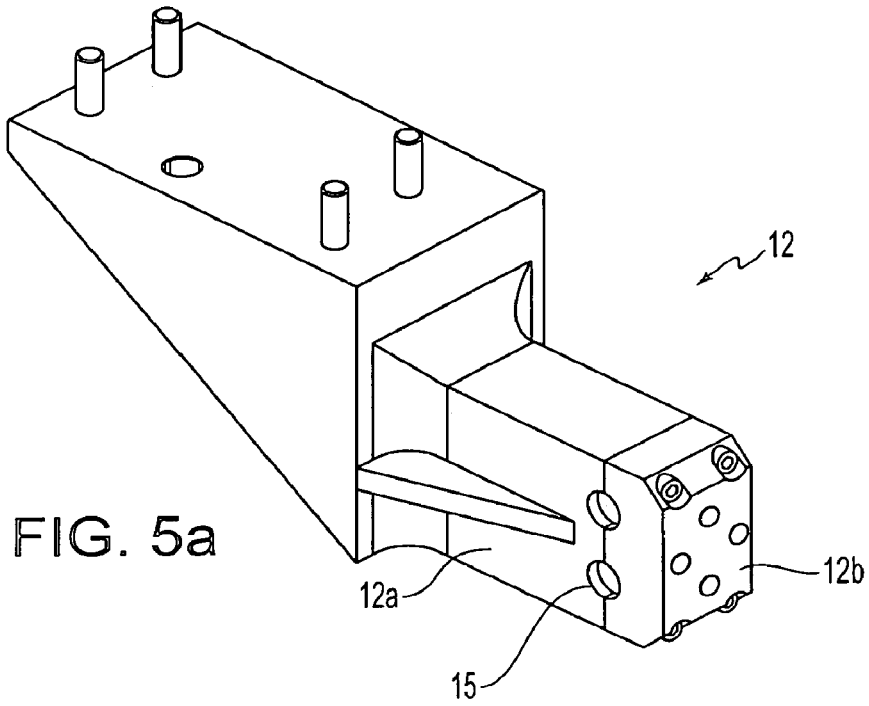
FIGS. 5*a* and 5*b* are two perspective views of the assembled socket.
Figure 5B:
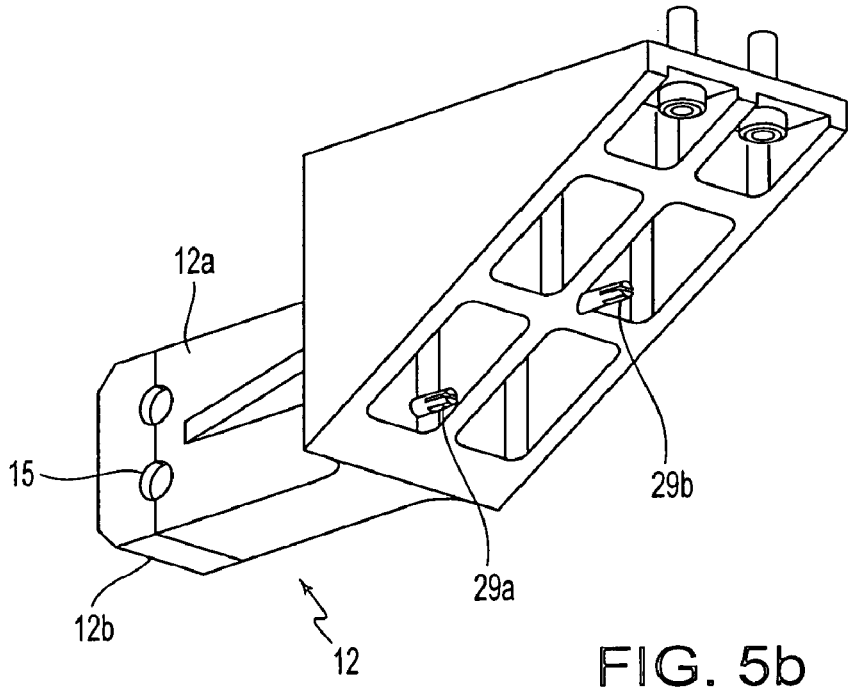

FIGS. 5*a* and 5*b* show the socket 12 assembled. FIG. 5*b* also shows the two rods 29*a* and 29*b*, which are each integral with a terminal 15. The conductors 17*a* and 17*b* will be fastened to the rods 29*a*, 29*b* by welding when the socket is being mounted onto the breechblock.

By way of a variant, it is possible for the socket to be connected to the cradle and the plug to be connected to the recoiling mass.

It is also possible for a connector to be defined according to the invention that has more than two plug-socket assemblies. There may be provided other plug-socket assemblies so as to conduct a programming signal intended for the ammunition or else to conduct a signal to the cradle to measure the temperature in the gun chamber.

The connector according to the invention is particularly well adapted to the conduction of a high voltage current such as that required to ignite a plasma igniter. It is, however, also possible to use the connector according to the invention to conduct an igniting current of moderate strength (of around an ampere), for example to ignite a classical igniter. In this case, the connector according to the invention provides an excellent quality of electrical contact between the recoil mass and the cradle whilst being simple in structure.

What is claimed is:

1. A device providing an electrical connection between a recoiling mass of a weapon and a fixed cradle, the device comprising at least one electrical connector formed of a plug and a socket, one of said plug and socket is integral with said cradle and the other one of said socket and said plug is integral with said recoiling mass, said socket and plug being disconnected during the recoil of said recoiling mass, wherein said one of said plug and said socket integral with said cradle is also integral with motor means allowing said one of said plug and said socket integral with said cradle to be displaced so as to ensure said one of said plug and said socket integral with said cradle disconnects when said recoiling mass is placed in a loading position before firing.

2. The device according to claim 1, wherein said plug incorporates contact pins integral with a support made of a flexible insulating material.

3. The device according to claim 2, wherein said socket incorporates at least two cylindrical contact terminals whose inner diameter is slightly less than that of said contact pins of said plug, each said terminal incorporating a longitudinal slot allowing said each said terminal to be deformed radially when a contact pin is introduced into said each said terminal.

4. The device according to claim 3, wherein each said plug incorporates at least two contact pins whose length extending from said plug is greater than or equal to a longitudinal length of said contact terminals.

5. The device according to claim 4, wherein said plug is integral with said cradle and said socket is integral with said recoiling mass.

6. The device according to claim 4, wherein said socket is integral with said cradle and said plug is integral with said recoiling mass.

* * * * *